US005988038A

United States Patent [19]

Feintuch

[11] Patent Number: 5,988,038

[45] Date of Patent: Nov. 23, 1999

[54] METHOD AND APPARATUS FOR DESTROYING BURIED OBJECTS

[75] Inventor: Paul L. Feintuch, Covina, Calif.

[73] Assignee: Raytheon Company, Lexington, Mass.

[21] Appl. No.: 09/010,600

[22] Filed: Jan. 22, 1998

[51] Int. Cl.[6] ..... B64D 1/04

[52] U.S. Cl. ..... 89/1.13

[58] Field of Search ..... 89/1.13, 1.11; 364/400

[56] References Cited

U.S. PATENT DOCUMENTS

| | | | |
|---|---|---|---|
| 5,291,819 | 3/1994 | Hambric | 89/1.13 |
| 5,307,272 | 4/1994 | Butler et al. | 364/424.02 |
| 5,448,936 | 9/1995 | Turner | 89/1.13 |
| 5,452,639 | 9/1995 | Aulenbacher et al. | 89/1.13 |
| 5,712,441 | 1/1998 | Grunewald | 89/1.13 |
| 5,808,969 | 9/1998 | Arnaud et al. | 367/103 |

*Primary Examiner*—Charles T. Jordan
*Assistant Examiner*—Jeffrey Howell
*Attorney, Agent, or Firm*—Colin M. Raufer; Leonard A. Alkov; Glenn H. Lenzen, Jr.

[57] ABSTRACT

An apparatus for destroying a buried object includes a targeting system including a sensor operable to detect the presence and location of an object which is at least partially buried in the ground, a gun system including a gun operable to fire a projectile into the ground, and a control system that aims the gun responsive to the presence and location of the buried object as determined by the targeting system. The sensor also desirably detects the presence and location of the projectile fired by the gun system, and the gun pointer is responsive to the location of the projectile. The sensor thus detects the presence of the buried object, the control system aims the gun at the buried object, and the gun fires the projectile. The sensor detects the relative positions of the buried object and the projectile as it passes near the buried object, the control system corrects the aim of the gun in the event that the prior shot misses, and the gun fires another projectile with a corrected aim.

12 Claims, 4 Drawing Sheets

METHOD AND APPARATUS FOR DESTROYING BURIED OBJECTS

BACKGROUND OF THE INVENTION

This invention relates to the destruction of buried objects, and, more particularly, to their destruction by a gun having a closed-loop control system.

Mines, booby traps, unexploded bombs, and other ordnance (collectively herein, "buried objects") buried up to a few feet below the surface of the ground are widely used by most armies as an inexpensive deterrent and impediment to invading ground forces. The removal or destruction of such buried objects is an important consideration for an opposing army moving into the mined region. Unfortunately, it is rare that the intentionally placed buried objects or other weapons such as unexploded buried bombs are carefully cleared after the conflict is over, leaving them in place and active. Many civilians throughout the world are injured and killed each year by the explosion of munitions in former combat areas, and the clearing of mine fields has become an important humanitarian concern.

In military situations, mine fields are often avoided completely or mapped so as to permit military personnel to move through the mine field while avoiding the mines. If it is necessary to destroy the buried objects, several techniques are available. In one, a heavy chain is pulled across the surface of the ground by two tanks and through the mine field, in an attempt to detonate the buried mines. This approach has the drawback that "smart mines" may be programmed to detonate only under certain conditions such as, for example, the passage of the third vehicle over the mine. In another approach, the mines, once detected, are fired at with rifles until they detonate, a slow and uncertain procedure. In yet another approach, the mines are individually dug up and exploded in place or taken to a disposal site, where they are intentionally exploded. This approach exposes personnel to the risk of injury.

The existing techniques for the disposal of buried objects are all limited in application and have drawbacks. There is therefore a need for an improved approach to the disposal of mines and other buried ordnance. The present invention fulfills this need, and further provides related advantages.

SUMMARY OF THE INVENTION

The present invention provides a method and apparatus for the disposal of objects buried up to about 3 feet deep in the ground. The technique destroys the buried objects quickly and efficiently, with no danger to personnel and at minimal cost of consumables. The apparatus may be readily packaged for use in military operations or by civilians in clearing mine fields after a conflict is over.

In accordance with the invention, an apparatus for destroying a buried object comprises a targeting system including a sensor operable to detect the presence and location of an object which is at least partially buried in the ground, a gun system including a gun operable to fire a projectile into the ground, and a control system that aims the gun responsive to the presence and location of the object as determined by the targeting system. Desirably, the sensor further detects the presence and location of the projectile fired by the gun system, and the control system is responsive to the location and/or trajectory of the projectile to correct the aim of the gun.

The sensor may be a passive sensor such as a magnetometer array, or an active sensor such as a ground-penetrating radar or an acoustic (sonar) transceiver, or some combination of sensor types. The sensor is preferably operable to detect a object at a depth of from more than 0 to about 3 feet below a surface of the ground. The targeting system further optionally includes a scanning drive supporting the sensor. The targeting system, the gun system, and the control system are preferably mounted on a vehicle such as a ground vehicle to provide mobility to move through a region suspected of having buried mines.

The apparatus is normally operated at a setback distance from the suspected location of the buried object, so that the detonation of the buried object will not damage the apparatus and its supporting vehicle. The fired projectile may therefore be angularly deflected as it enters the ground, both by the effective refraction as the projectile enters a medium of higher density at a relatively shallow angle and by small objects such as rocks in the ground. These effects are only partially predictable. The ability of the sensor to track the movement of the projectile in the vicinity of the buried object and for the control system to re-aim the gun responsive to the track of the projectile relative to the buried object is therefore important to achieving rapid, relatively low-cost destruction of the buried object by this approach. The apparatus may be operated in either the open-loop mode, where the paths of the projectiles are not used in refining the aim of the gun, or the closed-loop, feedback-control mode, where the paths of the projectiles are used in refining the aim of the gun.

The projectile may be of any operable type, such as a kinetically functioning projectile or a chemically functioning projectile. A brief discussion of various projectile systems is found in pending patent application Ser. No. 08/993,544, filed on Dec. 18, 1998; and U.S. Pat. No. 5,448,936, titled "Destruction of Underwater Objects," which issued on Sep. 12, 1995; both of which are assigned to this assignee and are incorporated herein by reference. Preferably, the projectile fragments upon impacting the buried object and disperses a reactive fill material into the explosive of the mine, causing the explosive to undergo an explosion-like chemical and kinetic reaction which provides a visual confirmation of the neutralization of the mine.

The present invention provides an important advance for both military operations and also for the clearing of dangerous buried munitions after hostilities are over. Large numbers of buried objects may be disposed of in place, without danger to personnel and with relatively small consumables costs. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
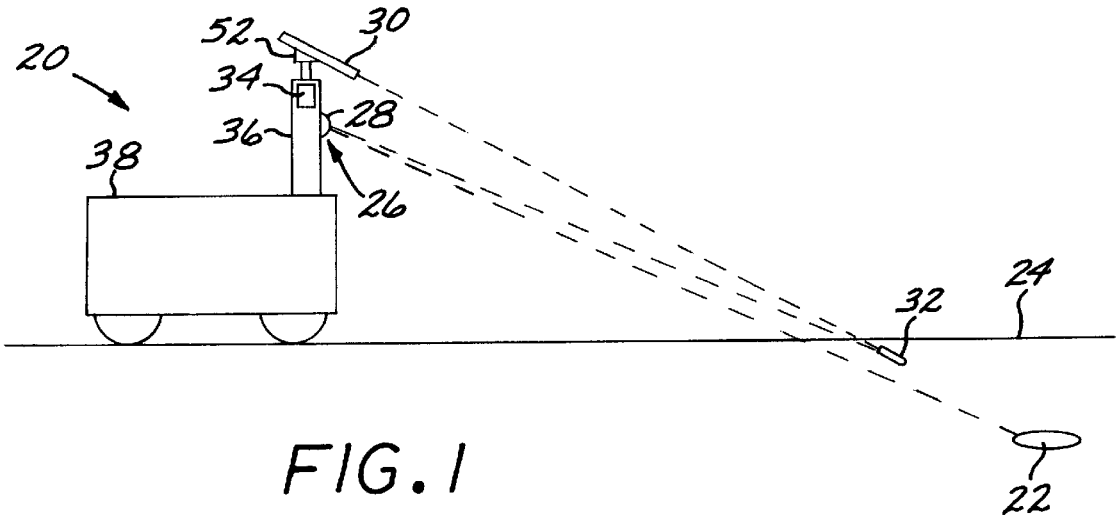
FIG. 1 is a schematic depiction of an apparatus for destroying a buried object.

FIG. 1 schematically depicts an apparatus 20 for destroying a buried object 22 which is buried below a surface 24 of the ground, such as a mine, a booby trap, an unexploded bomb, other ordnance, or other object. The object 22 may be buried wholly or partially. It is typically buried at a depth of greater than 0 but less than about 3 feet below the surface 24.

The apparatus 20 includes a targeting system 26 having a sensor 28 which detects the presence and location of the buried object 22 and other objects, and a gun 30 which fires projectiles 32, one of which is shown in FIG. 1, capable of destroying the buried object 22 upon impact. A control system 34 receives information from the targeting system 26 and aims the gun 30 toward the buried object 22. The cooperative operation of the targeting system 26, the gun 30, and the control system 34 will be discussed in greater detail subsequently. The gun 30 is normally mounted at a location separated from the sensor 28, in the illustrated case at the top of a mast 36. The apparatus 20 also preferably includes a manned or unmanned vehicle 38, such as a truck, upon which the remaining elements are mounted, so that the apparatus 20 may be moved to a position adjacent to the object 22, but sufficiently separated from it so that its destruction does not damage the apparatus 20.

Figure 2:
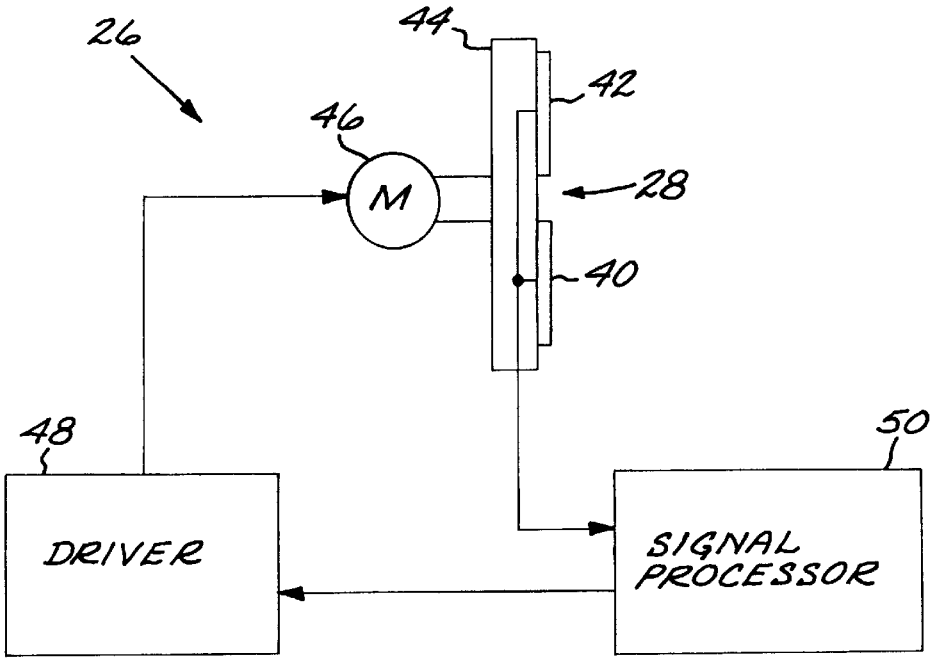
FIG. 2 is a schematic depiction of the targeting system.

The targeting system 26 may be of any operable type, and the components required in the targeting system will depend upon the type selected. The targeting system may not be a laser-based targeting system, however, whose beam will not penetrate the ground. FIG. 2 illustrates generally such a targeting system 26 as used herein. The sensor 28 is selected to be responsive to the presence and location of objects to be sensed, specifically the types of buried objects to be destroyed and the projectiles that are to destroy them. The sensor 28 may include an active sensor such as a ground-penetrating radio frequency radar transceiver or an acoustic (sonar) transceiver. The sensor 28 may also include a passive sensor such as a magnetometer array. The construction and operation of such sensors is well known for other applications.

The targeting system may use two or more of the individual types of sensors in a cooperative manner in order to locate a variety of types of buried objects and precisely determine their positions. For example, an acoustic transceiver may be provided for relatively longer-range, lower-accuracy determinations, a ground-penetrating radar transceiver for medium-range determinations, and a magnetometer array for close-in, accurate determinations of the position of the buried object. The data produced by the multiple sensors is fused into a mapping of buried objects in the far range and near range relative to the targeting system.

The sensor 28 includes a receiver 40 and, only for the case of an active sensor, a transmitter 42. (A passive sensor such as a magnetometer array has no transmitter.) The receiver 40 and, where present, the transmitter 42 are mounted on a support 44 which may be moved by a scan motor 46 so as to direct the sensor 28 in a desired direction. The scan motor 46 is commanded by a driver 48. The driver 48 is normally programmed to scan the sensor 28 ahead and to the sides of the path of the vehicle 38 until a potential target buried object is located, and thereafter to aid in aiming the gun to destroy that buried object. Thus, the targeting system may provide both the initial locating of the buried objects and the precision information to destroy it, or the initial locating information may be provided from other sources.

The data gathered by the receiver 40 is provided to a signal processor 50, in which it is processed to identify features in the form of the buried objects 22 and the projectiles 32. The signal processor 50 typically has as an output the location of a target object in either Cartesian (x, y, z) or spherical (r, θ, Φ) coordinates, with sufficient information to provide its location relative to the sensor 28. The signal processor 50 may also provide a signal to the driver 48 to aim the sensor 28 more precisely toward the target object. The targeting system illustrated in FIG. 2 is generic. Particular types of sensors may require special forms of the targeting system, which are known for each type of sensor. For example, an acoustic sensor may require the transmitter 42 and the receiver 40 to be in contact with the surface of the ground.

The gun 30 is a projectile-firing device, such as a 50-caliber gun or a 20 millimeter cannon. The use of a projectile is selected as the most cost-effective approach to destroying large numbers of buried objects. The gun 30 is mounted on a gimbaled, motor-driven support 52 that permits it to be aimed in a selected angular direction.

The projectile 32 may be of any operable type designed to destroy the buried object. The projectile may be essentially inert, so that the buried object, when struck, is destroyed by fragmentation and kinetic energy. The projectile may include an explosive, so as to explode when it strikes the buried object. More preferably, the projectile contains a chemical that, when dispersed into contact with the explosive material contained within the buried object, causes an explosion-like chemical reaction that destroys the buried object. The latter approach is preferred, inasmuch as it yields a positive visual confirmation of the destruction of the buried object. In the case of the kinetic-kill projectile and the explosive projectile, impacts with objects such as buried rocks could be misinterpreted as impact with a buried explosive device, while an explosion only occurs if the chemical-containing projectile impacts and penetrates a buried explosive device so that there is a reaction between the chemical and the explosive.

Figure 7:
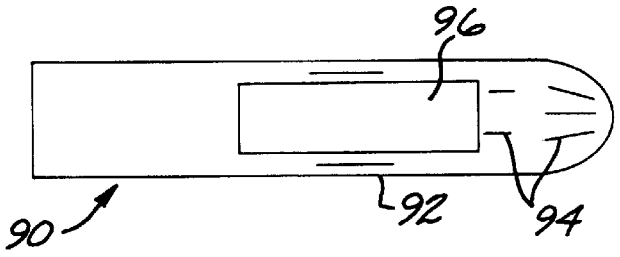
FIG. 7 is a schematic sectional view of a projectile operable with the present approach.

FIG. 7 illustrates a projectile 90 of the preferred type. The projectile includes a casing 92 having a bullet shape and designed to fragment under conditions of impact with an object. To encourage fragmentation, fragmentation grooves 94 may be provided on the exterior surface of the casing. A cavity 96 is contained within the casing 92. The cavity 96 is filled with a chemical that reacts with the explosive material of the buried object to produce an explosion-like chemical reaction. A preferred such chemical is a strong oxidizer such as lithium perchlorate oxidizer. In operation, when the projectile 90 strikes a buried object, it fragments and disperses the chemical contained within the cavity. If the object is an explosive device, it is typically partially fragmented as well. The chemical from the projectile chemically reacts with the explosive material exposed by the fragmentation of the explosive device, resulting in a chemical reaction that is similar to an explosion. An observer may visually confirm that a mine or other explosive device has been destroyed. If, on the other hand, the underground object is a rock or other inert object, the projectile may fragment and disperse its chemical, but there will be no explosion-like chemical reaction.

Figure 3:
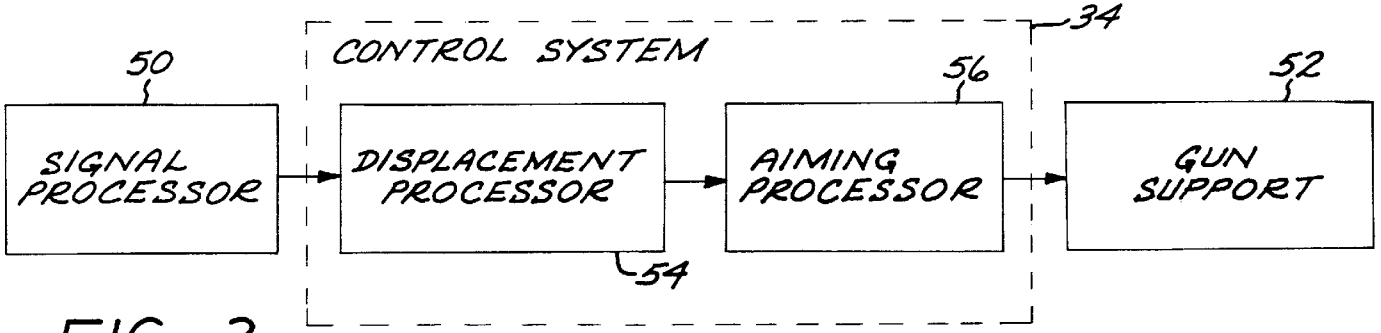
FIG. 3 is a schematic depiction of the control system.

The control system 34, illustrated in FIG. 3, includes a displacement processor 54 that receives information from the signal processor 50 of the targeting system 26, as to the location of the buried object 22 and, in closed loop operation, the location of fired projectiles 32. The displacement processor 54 compares the locations of the buried object 22 and the fired projectiles 32 when they reach the depth of the buried object, and determines the difference in their position. This difference is provided to an aiming processor 56, which determines the angular correction to be provided to the gun support 52 to correct the aim of the next-fired projectile so that it is even closer to the target buried object. Eventually, with this feedback aiming procedure, one of the fired projectiles impacts the buried object, causing its destruction. The displacement processor 54 and the aiming processor 56 are presented as separate processors for clarity of discussion, but in practice both displacement determinations and aiming determinations are preferably performed by a single microprocessor.

Figure 4:
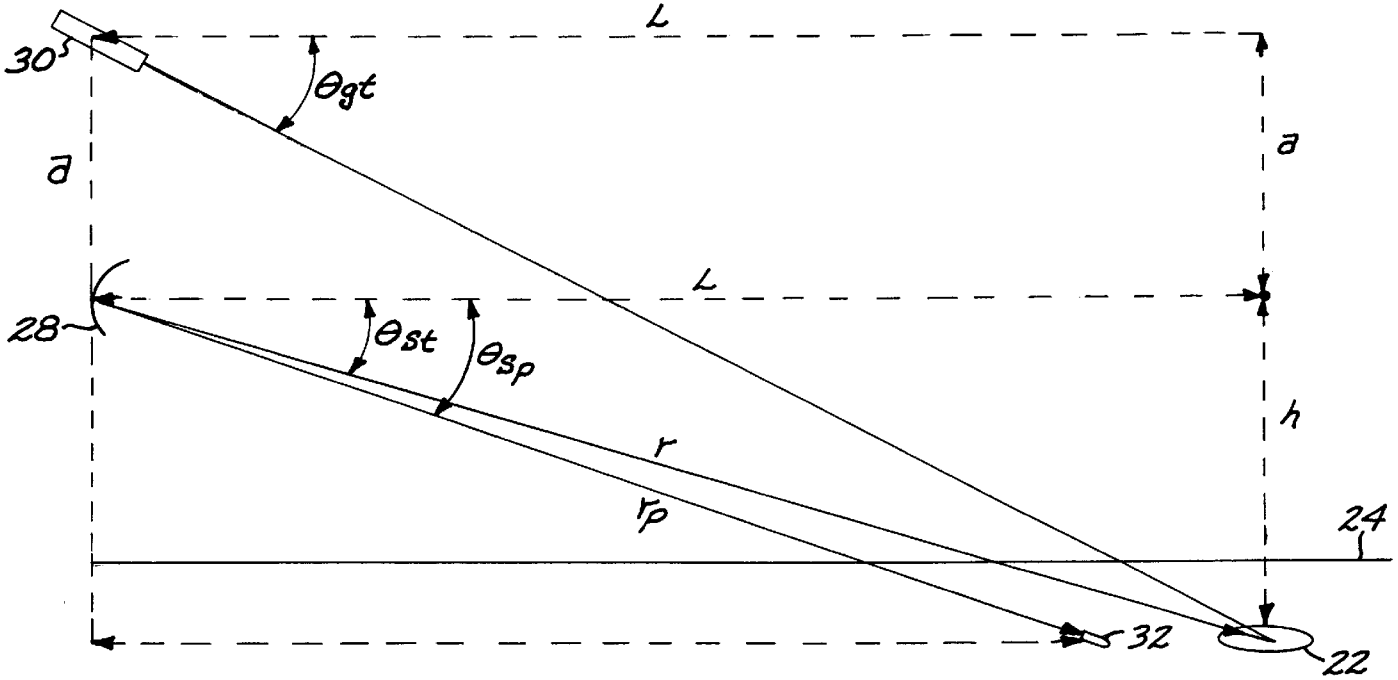
FIG. 4 is a diagram of the geometric relation of the targeting system and the gun system with the buried object for the embodiment of FIG. 1.

FIG. 4 schematically presents, in simplified form, the geometrical relations used in the feedback, closed-loop mode of operation of the apparatus 20. This figure relates to the angle of depression of the sensor and the gun, and azimuthal aiming is accomplished in a similar fashion. The sensor 28 selected for this example is the active ground-penetrating radar, but similar considerations hold for other sensor types such as the active acoustic sensor and the magnetometer array. The horizontal distance L from the sensor 28 to the buried object 22 is $L=r \cos \theta_{st}$, where r is the line-of-sight distance to the object and $\theta_{st}$ is the line-of-sight angle of depression of the sensor to the object, relative to the horizontal. The values of r and $\theta_{st}$ are determined by the signal processor 50 using the data of the sensor 28. The vertical distance h from the sensor 28 to the object 22 is $h=r \sin \theta_{st}$. The corresponding depression angle $\theta_{gt}$ at which the gun 30 must be depressed for a line of sight to the target buried object is $\theta_{gt}=\tan^{-1}((h+a)/L)$, where a is the vertical separation of the sensor 28 and the gun 30 on the mast 36. The gun is slaved to the sensor through these relations and the control procedure described in regard to FIG. 3.

It is usually the case that the first projectile fired misses the target buried object, either due to inherent inaccuracy in the gun, deflection of the projectile as it enters the ground, or other reasons. However, the ground-penetrating radar sensor may be used to follow the course of the projectile and to correct the aim of the gun to bring the path of the next projectile closer to that required to impact the buried object. In FIG. 4, the position of the missing projectile 32 is given by $L_p=r_p \cos \theta_{sp}$ and $h_p=r_p \sin \theta_{sp}$, and $\theta_{gp}=\tan^{-1}((h_p+a)/L_p)$, where the subscript p indicates the missing projectile. An aiming correction $\delta 74_g$ is the angular change required to redirect the aim of the gun so that the next projectile impacts the buried object and is determined exactly from the relations given above.

Figure 5:
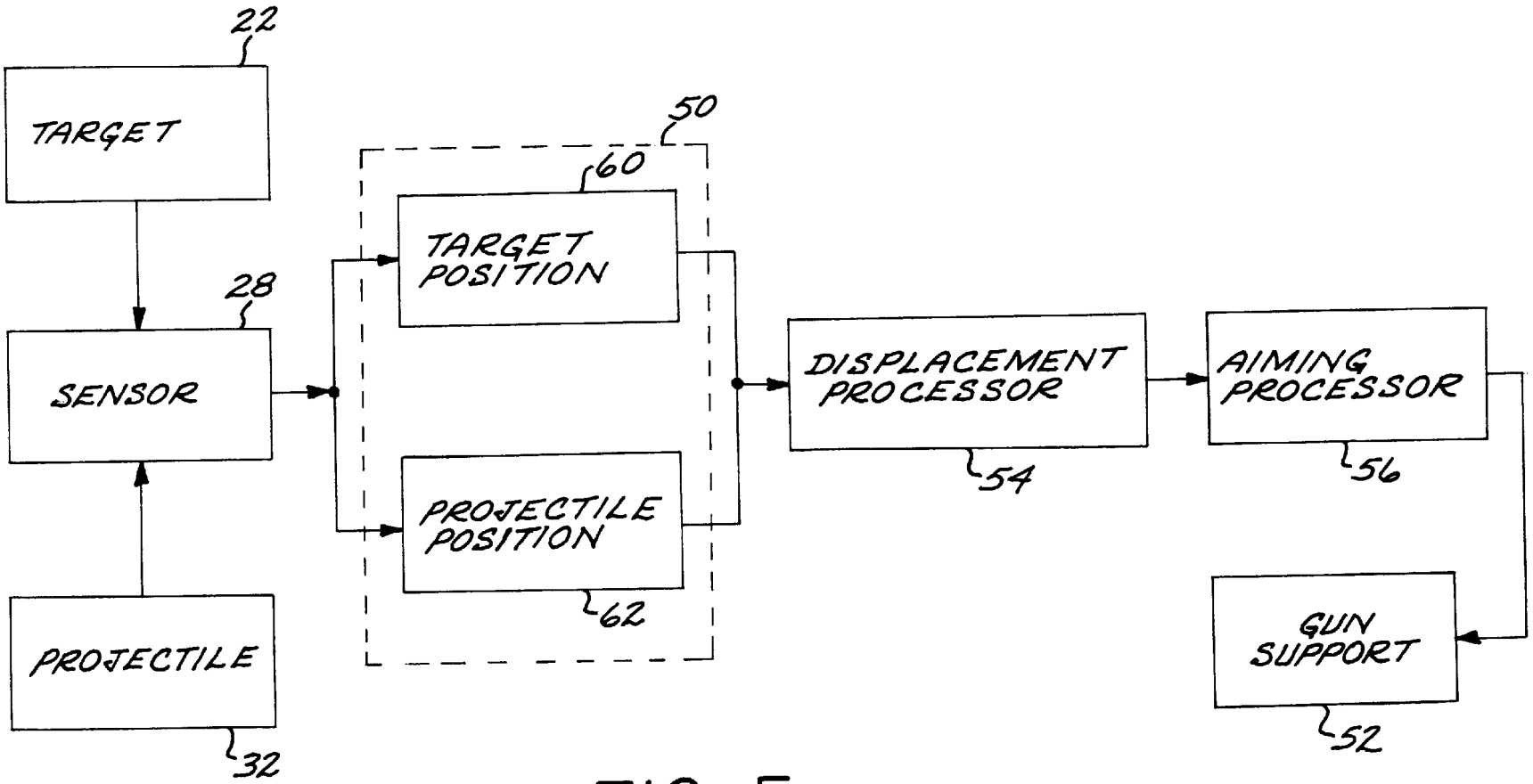
FIG. 5 is a block diagram of the interrelation of the elements of the targeting, control, and gun systems in closed-loop operation.

FIG. 5 illustrates the relation of the pertinent elements of the apparatus in the closed-loop feedback operational mode. The sensor 28 identifies and gathers information on the target buried object 22 and the projectile 32, to obtain a target position 60 and a projectile position 62, in the signal processor 50. This information is provided to the displacement processor to determine the difference in the relative positions of the buried object 22 and the projectile 32. The resulting information is provided to the aiming processor 56, which determines the angular aiming correction required, $\delta\theta_g$ in the above example, which is then provided to the gun support 52 so as to re-aim the gun for the next shot.

Figure 6:
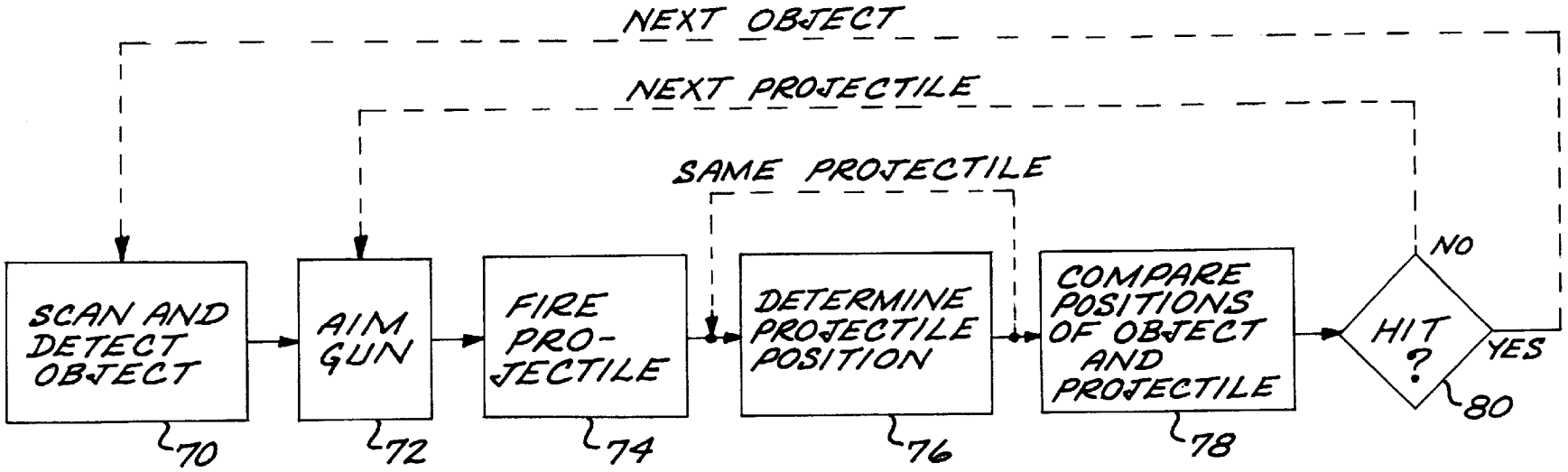
FIG. 6 is a block flow diagram of the destruction of targets when the system is operated in a closed-loop fashion.

FIG. 6 depicts the overall approach by which a buried object is located and destroyed using the approach of the invention. The targeting system 26 is operated in the scanning mode to initially locate a buried object, numeral 70. Once an object is located and identified, the gun is initially aimed according to the approach described above, numeral 72, and a projectile is fired, numeral 74. The projectile's position is continuously determined, numeral 76. As the projectile passes the depth in the ground of the buried object, the positions of the projectile and the object are compared, numeral 78. If the projectile does not hit the buried object, numeral 80, the aim of the gun is corrected using the comparison information from step 78, and another projectile is fired, numeral 74. This sequence is repeated until the next-fired projectile hits and destroys the buried object. At this point, numeral 80, the targeting system 26 resumes the scanning mode to search for the next buried object to be destroyed.

The same procedures and hardware are used if the apparatus is to be operated in the open-loop fashion, firing toward the object until it is hit but without information on the path of the projectile, with the following modifications: steps 76 and 78 are omitted, and the gun re-aiming is performed in a random, stepwise, or other fashion until the buried object is destroyed.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. Apparatus for destroying a buried object, comprising:

a targeting system including a sensor operable to detect the presence and location of an object which is at least partially buried in the ground;

a gun system including a gun operable to fire a projectile into the ground, wherein the projectile comprises a cavity therein, and a reactive chemical in the cavity; and a control system that aims and fires the gun responsive to the presence and location of the object as determined by the targeting system.

2. The apparatus of claim 1, wherein the sensor further detects the presence and location of a projectile fired by the gun system, and wherein the control system is further responsive to the location of the projectile as determined by the targeting system.

3. The apparatus of claim 1, wherein the sensor comprises a passive sensor.

4. The apparatus of claim 1, wherein the sensor comprises a magnetometer array.

5. The apparatus of claim 1, wherein the sensor comprises an active sensor.

6. The apparatus of claim 1, wherein the sensor comprises a ground-penetrating radar.

7. The apparatus of claim 1, wherein the sensor comprises an active acoustic sensor.

8. The apparatus of claim 1, wherein the sensor comprises at least two sensor types selected from the group consisting of a ground-penetrating radar, an active acoustic sensor, and a magnetometer array.

9. The apparatus of claim 1, wherein the sensor is operable to detect a object at a depth of from more than 0 to about 3 feet below a surface of the ground.

10. The apparatus of claim 1, wherein the targeting system further includes a scanning drive supporting the sensor.

11. The apparatus of claim 1, further including a vehicle upon which the targeting system, the gun system, and the control system are mounted.

12. Apparatus for destroying a buried object, comprising:

a targeting system including a sensor of the presence and location of a stationary object which is at least partially buried in the ground, and the presence and location of a projectile moving in the ground;

a gun system including a gun, and a plurality of projectiles that may be fired by the gun wherein each projectile comprises a cavity therein, and a reactive chemical in the cavity; and a control system operable to initially aim the gun responsive to the presence and location of the object as determined by the targeting system, and to subsequently correct the aim of the gun responsive to the difference between the location of the projectile and the location of the object as determined by the targeting system.

* * * * *